US008652725B2

(12) United States Patent
Watanabe et al.

(10) Patent No.: US 8,652,725 B2
(45) Date of Patent: Feb. 18, 2014

(54) TONER

(75) Inventors: Emi Watanabe, Suntou-gun (JP); Naotaka Ikeda, Suntou-gun (JP); Yuhei Terui, Numazu (JP); Kenji Aoki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 12/952,187

(22) Filed: Nov. 22, 2010

(65) Prior Publication Data

US 2011/0136054 A1 Jun. 9, 2011

(30) Foreign Application Priority Data

Dec. 4, 2009 (JP) ..... 2009-276355

(51) Int. Cl.
*G03G 9/00* (2006.01)

(52) U.S. Cl.
USPC ..... 430/108.6; 430/108.1; 430/108.7

(58) Field of Classification Search
USPC ..... 430/108.1, 108.6, 108.7
See application file for complete search history.

(56) References Cited

U.S. PATENT DOCUMENTS

| | | | | |
|---|---|---|---|---|
| 6,130,020 | A | 10/2000 | Wada et al. | |
| 6,936,394 | B2 | 8/2005 | Okado et al. | |
| 7,704,661 | B2 | 4/2010 | Ikeda et al. | |
| 2006/0057385 | A1* | 3/2006 | Schumacher et al. | 428/404 |
| 2008/0304869 | A1* | 12/2008 | Sukeno et al. | 399/262 |
| 2009/0130582 | A1 | 5/2009 | Handa et al. | |
| 2009/0239171 | A1* | 9/2009 | Anno et al. | 430/109.4 |
| 2010/0330493 | A1* | 12/2010 | Kaneeda et al. | 430/111.1 |

FOREIGN PATENT DOCUMENTS

| | | | |
|---|---|---|---|
| EP | 1876144 | A1 | 1/2008 |
| JP | 3587672 | B | 11/2001 |
| JP | 3587671 | B | 11/2004 |
| JP | 2006-306651 | A | 11/2006 |
| JP | 2008-112046 | A | 5/2008 |

OTHER PUBLICATIONS

EP 2239229 by Kaneeda et al. is provided as a translation of WO 2009084184 A1.*

Sugiyama, et al., U.S. Appl. No. 12/908,402, filed Oct. 20, 2010.

Brandrup, et al., "Polymer Handbook", 2nd Edition, John Wiley & Sons, New York, pp. 11-139-11-192.

* cited by examiner

*Primary Examiner* — Stewart Fraser

(74) *Attorney, Agent, or Firm* — Fitzpatrick, Cella, Harper and Scinto

(57) ABSTRACT

A toner having toner base particles each of which contains at least a binder resin and a colorant, and silica titania composite particles. The silica titania composite particles contain silica in an amount of from 55.0% by mass to 85.0% by mass; and, in a chart obtained by the measurement by X-ray diffraction of the silica titania composite particles and where, in respect of a peak having the highest diffraction intensity and a peak having the next-highest diffraction intensity among peaks present in the range of 2θ=24.0 to 29.0, the value of area of the peak on the lower-angle side is represented by Xa and the value of area of the peak on the higher-angle side is represented by Xb, the ratio of Xa/Xb is from 95/5 to 75/25.

3 Claims, 2 Drawing Sheets

TONER

BACKGROUND OF THE INVENTION

1. Field of the Invention

This invention relates to a toner used in image recording processes such as electrophotography, electrostatic printing and toner jet recording.

2. Description of the Related Art

In recent years, because of progress in computers and multimedia, it is sought to provide means which can reproduce high-definition images in a broad field extending from offices to homes. Accordingly, it is needed to provide means which can reproduce high-quality images without being affected by any environmental variations even in a cold and dry environment and in a high-temperature and high-humidity environment.

In general, most toners are those to the base particle surfaces of which an inorganic fine powder or fine particles formed of resin has or have been added. In virtue of the presence of such particles, performance such as chargeability or fluidity of toners is improved. However, where two or more different kinds of inorganic fine powders are used, only one of the inorganic fine powders for example may come off, or come buried in, the base particles as a result of long-term continuous service to make it difficult for the toners to retain the fluidity, charging stability, environmental stability and so forth they have at the initial stage.

Accordingly, studies are made on what is called composite particles, which are made up by using two or more compounds. Such toners making use of composite particles are known to be effective in maintaining toner performance over a long period of time because the properties of the compounds used are individually brought out and the charging is stably maintained even under conditions such as long-term continuous service and environmental variations. For example, a technique is proposed in which silica composite particles containing aluminum, boron or titanium are used to make toners retain initial-stage charge characteristics even in their long-term continuous service (see, e.g., Japanese patent Nos. 03587671 and 03587672). A technique is also proposed in which the content of titania in silica titania composite particles and BET specific surface area thereof are specified so as to make toners improved in their environmental stability (see, e.g., Japanese Patent Application Laid-open No. 2006-306651). Meanwhile, a technique is still also proposed in which the content of titania in silica titania composite particles and the particle diameter of the silica titania composite particles are specified so as to make toners retain fluidity in their long-term leaving (see, e.g., Japanese Patent Application Laid-open No. 2008-112046).

The above Japanese patent Nos. 03587671 and 03587672 report that toners can well retain charge characteristics in their long-term continuous service. However, the composite particles used therein have an insufficient hydrophobicity, and you must worry about a decrease in charge characteristics of toners that is due to their continuous service or leaving in a high-temperature and high-humidity environment.

The above Japanese Patent Application Laid-open No. 2006-306651 reports that the titania in silica titania composite particles is in a content of 50% by mass or more and this promises superior environmental stability and charging stability. However, you must worry about a lowering of fluidity and chargeability of toners in their long-term continuous service.

The above Japanese Patent Application Laid-open No. 2008-112046 reports that the titania in silica titania composite particles is in a large content and also the particle diameter of the silica titania composite particles are specified, and this enables toners to retain fluidity in their long-term leaving. However, you must worry about a lowering of fluidity and chargeability of toners in their long-term continuous service.

SUMMARY OF THE INVENTION

The present invention is a toner having silica titania composite particles, and is concerned with a toner the charge characteristics of which have been kept from lowering during its long-term continuous service or after its long-term leaving. It is also concerned with a toner which can retain good charge characteristics even in a high-temperature and high-humidity environment.

That is, the present invention aims to provide a toner which does not cause any fog due to a great decrease in charge quantity of the toner even when images are copied or printed over a long period of time not only in a normal-temperature and normal-humidity environment but also in a high-temperature and high-humidity environment. It also aims to provide a toner having been kept from causing any melt-sticking of toner to a toner carrying member. It further aims to provide a toner which can keep development lines from coming about that are caused by any partial melt-sticking of toner to the surface of a toner control member to make the toner coat non-uniform on the toner control member.

Characteristic features of the present invention that is to achieve the above objects are as described below.

The present invention is a toner which comprises toner base particles each of which contains at least a binder resin and a colorant, and silica titania composite particles, and is characterized in that; the silica titania composite particles contain silica in an amount of from 55.0% by mass to 85.0% by mass; and in a chart obtained by the measurement by X-ray diffraction of the silica titania composite particles and where, in respect of a peak having the highest diffraction intensity and a peak having the next-highest diffraction intensity among peaks present in the range of $2\theta=24.0$ to 29.0, the value of area of the peak on the lower-angle side is represented by Xa and the value of area of the peak on the higher-angle side is represented by Xb, the ratio of Xa/Xb is from 95/5 to 75/25.

According to the present invention, the content of silica in the silica titania composite particles and the crystal structure of titania in the silica titania composite particles are specified, and this enables improvement in dispersibility of the silica titania composite particles on or over the surfaces of the toner base particles and also enables the silica titania composite particles to be kept from coming liberated from the toner base particles. As the result, the toner can well retain the charge characteristics during its long-term continuous service or after its long-term leaving and further even in a high-temperature and high-humidity environment. Thus, images can be kept from having a low image quality due to any fog, development lines and so forth, so that good images can stably be obtained.

Further features of the present invention will become apparent from the following description of exemplary embodiments with reference to the attached drawings.

DESCRIPTION OF THE EMBODIMENTS

Figure 1:
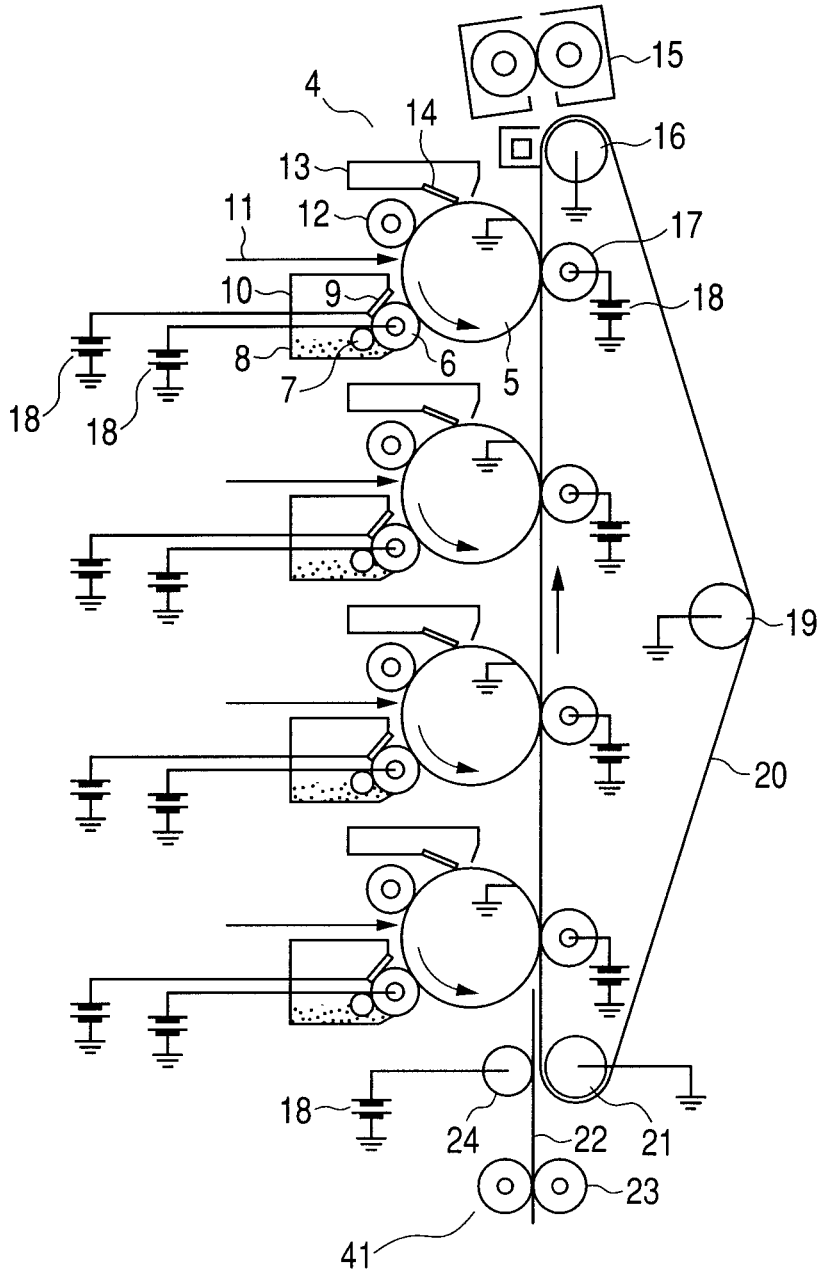
FIG. 1 is a schematic sectional view of an image forming apparatus usable in the present invention.

Preferred embodiments of the present invention will now be described in detail with reference to the accompanying drawings.

The silica titania composite particles according to the present invention has both the effect of fluidity and dispersibility that is attributable to the silica and the effect of environmental stability that is attributable to the titania, and hence can be a material suited for the controlling of toner performance by their presence on the toner base particles.

In general, the titania has a low electrical resistance, and hence it is effective in improving charging rise performance of the toner, and especially effective in improving initial-stage image characteristics after any long-term leaving of the toner. However, the presence of such titania on the surfaces of toner base particles tends to make some electric charges of toner particles come released, so that the toner tends to cause attenuation of charge quantity. Such a phenomenon is remarkable especially during long-term continuous service of the toner.

The silica titania composite particles contained in the toner of the present invention contains the silica in an amount of from 55.0% by mass to 85.0% by mass. Hence, the titania is present in a smaller amount than the silica also on the base particle surfaces, and hence the attenuation of charge quantity can easily be kept from occurring. Meanwhile, the effect of improving charging rise performance that is originally possessed by the titania is also brought out. Here, in the present invention, the toner base particles refer to untreated particles having been not subjected to any surface treatment with a treating agent such as a hydrophobic-treating agent, and, as will be detailed later, may be used after the toner base particles have been surface-treated or may be used without any surface treatment.

If the silica titania composite particles contains the silica in an amount of less than 55.0% by mass, it may be difficult to form the structure in which titania is covered with silica, to accelerate the attenuation of charge quantity. As the result, this may cause the silica titania composite particles to melt-stick to the toner carrying member and toner coat control member, tending to cause image defects such as fog and development lines. If on the other hand the silica titania composite particles contains the silica in an amount of more than 85.0% by mass, i.e., if the titania is in a content of less than 15.0% by mass, the effect of improving charging rise performance that is possessed by the titania is not sufficiently brought out, so that the toner may come to have a poor chargeability especially after its long-term leaving. As the result, this may make the toner have a low charging performance to tend to cause fog.

Further, the silica titania composite particles contained in the toner of the present invention are those in which, in a chart obtained by the measurement by X-ray diffraction of the silica titania composite particles and where, in respect of a peak having the highest diffraction intensity and a peak having the next-highest diffraction intensity among peaks present in the range of $2\theta=24.0$ to 29.0, the value of area of the peak on the lower-angle side is represented by Xa and the value of area of the peak on the higher-angle side is represented by Xb, the ratio of Xa/Xb is from 95/5 to 75/25.

In the X-ray diffraction, two peaks having higher intensities among peaks present in the range of $2\theta=24.0$ to 29.0 are due to the crystal structure of titania in the silica titania composite particles, where the peak present on the lower-angle side, stated specifically, at $2\theta=25.3\pm0.5$ is a peak of the anatase type of titania crystals and the peak present on the higher-angle side, stated specifically, at $2\theta=27.4\pm0.5$ is a peak of the rutile type of titania crystals. That is, this means that the titania crystals are of mixed crystals.

The anatase type has features that it has a larger specific surface area and also a lower electrical resistance than the rutile type. More specifically, the anatase type having a larger specific surface area may be used in a large quantity, and this facilitates control of the titania so as to have a structure in which titania is easily covered with silica, and enables achievement of the effect of improving charging rise performance of the toner, as so presumed.

If the Xa is larger than 95, the silica titania composite particles have a low electrical resistance, so that such particles may accelerate the attenuation of charge quantity. As the result, during long-term continuous service, any toner having come to have a low charge quantity and, as being attendant thereon, any silica titania composite particles having come off the toner base particles may contaminate the toner carrying member and toner coat control member to tend to cause image defects such as development lines and any fog attendant on melt-sticking of toner. If on the other hand the Xa is smaller than 75, the silica titania composite particles may unwantedly have a structure in which titania is not easily covered with silica, and, in this case as well, such particles may also unwantedly accelerate the attenuation of charge quantity. As the result, such particles may contaminate the toner carrying member and toner coat control member to tend to cause image defects such as development lines and any fog attendant on melt-sticking of toner. Preferably, the ratio Xa/Xb=90/10 to 85/15, where the above effect can much more be brought out.

The silica titania composite particles contained in the toner of the present invention may preferably be used after they have been hydrophobic-treated. Having been hydrophobic-treated makes the particles not easily affected by environmental variations, and this is preferable because good charge characteristics can be retained especially in a high-temperature and high-humidity environment. Where the silica titania composite particles are hydrophobic-treated, the particles having been treated may preferably have a hydrophobicity of 60.0% or more, and much preferably 70.0% or more. Inasmuch as the particles have a hydrophobicity of 60.0% or more, such particles can not easily be affected by water content even in a high-temperature and high-humidity environment, and hence better charge characteristics can be achieved. If, however, it is attempted to make the particles have a hydrophobicity of more than 90.0%, it may come necessary to use a hydrophobic-treating agent in a large quantity, so that the hydrophobic-treating agent may come liberated from the base particles or the silica titania composite particles thus treated may come to have a low fluidity. Thus, it is preferable for their hydrophobicity to be 90.0% or less.

There are no particular limitations on how to carry out such hydrophobic treatment, and what is used as the treating agent may include treating agents such as an unmodified silicone varnish, a modified silicone varnish of various types, a modified silicone oil, a modified silicone oil of various types, silane compounds, silane coupling agents, other organosilicon compounds, and organotitanium compounds. Any of these treating agents may be used alone or in combination.

As silica titania composite particles standing untreated, they may preferably have a volume resistivity of from $1.0\times10^{4}$ Ω·m or more to $1.0\times10^{8}$ Ω·m or less. As those having been untreated, they may preferably have a volume resistivity of from $1.0\times10^{12}$ Ω·m or more to $1.0\times10^{14}$ Ω·m or less.

Stated specifically, as long as the particles having not been hydrophobic-treated have volume resistivity within the above range, it means that the titania has been kept from being laid bare to the particle surfaces and that any particles of titania alone which contain no silica are substantially not present. Hence, the toner can have a good chargeability even where it has been long-term left in a high-humidity environment. In addition, the toner can well be kept from undergoing charge-up during its long-term continuous service.

Meanwhile, as long as the particles having been hydrophobic-treated have volume resistivity within the above range, the toner can be kept from coming to have a broad charge distribution even during service in a high-humidity environment, and can well be kept from causing any fog and from coming to have a low transfer performance. The toner can also well be kept from undergoing any charge-up in a high-humidity environment.

The silica titania composite particles may preferably have a number average particle diameter (D1) of from 5 nm to 35 nm. As long as the silica titania composite particles have number average particle diameter within the above range, even when used over a long period of time, the silica titania composite particles can be kept from coming buried in or liberated from the toner base particles, and the toner can stably be provided with its fluidity, as being preferable.

The silica titania composite particles according to the present invention have no limitations on how to produce them, and may preferably be those produced by a gaseous-phase process. Their production by a gaseous-phase process can enjoy a high composite rate of silica and titania, and can readily provide a structure in which titania is uniformly covered with silica. Further, any sole particles not made into composite particles, such as silica particles or titania particles, are kept from being formed, and any image defects such as development lines and fog can be kept from occurring that may be brought about by any member contamination due to such sole particles.

Further, in the gaseous-phase process, the silica is formed after silicon tetrachloride gas is introduced into a combustion burner through feed nozzles, and likewise the titania is formed from titanium tetrachloride gas. Taking account of a difference in reaction rates at which the silica and the titania are formed, any of gas flow rate proportion, combustion time, combustion atmosphere, nozzle position in introducing each gas, and so forth may compositely be adjusted, and this enables control of the structure, composition and physical properties of the silica titania composite particles used in the present invention. In particular, the controlling of temperature at the time of flame hydrolysis in the gaseous phase enables control of the ratio Xa/Xb to be found by X-ray diffraction.

It is preferable that the toner of the present invention contains from 30 ppm to 1,000 ppm of a titanium element in the toner base particles. As long as the content of the titanium element in the toner base particles is within the above range, the toner can enjoy a good charging rise performance even after it has been left to stand for a long term in a high-temperature and high-humidity environment. It can also easily be kept from causing its charge-up even in its continuous service in a low-temperature and low-humidity environment.

The level of the titanium element to be contained in the toner base particles of the present invention may be controlled in whatever way. For example, a way may be given which makes use of a polyester resin produced in the presence of a titanium compound as a catalyst. In particular, in a toner produced by suspension polymerization in an aqueous medium, it is preferable to use a polar resin polyester resin in the state it is incorporated in a monomer composition. In this case, the polyester resin can be localized to toner particle surfaces, and hence the titanium element can dispersedly be much present in the vicinity of toner particle surfaces. The titanium compound has a lower electrical resistance than the above copolymer or the resin such as polyester, and hence, when the toner is triboelectrically charged, such titanium compound standing finely dispersed in the vicinity of the toner particle surfaces are considered to function as sites through which electric charges are injected or come to leak. Accordingly, when left to stand for a long term in a high-temperature and high-humidity environment, the titanium compound so acts that the toner particles can retain a large charge quantity when left to stand for a long term in a high-temperature and high-humidity environment, and, in a low-temperature and low-humidity environment, the titanium compound acts as leak points, and so acts as to appropriately keep the toner from causing its charge-up. Moreover, the presence of such leak sites enables electric charges to be well transferred between the toner particles one another, to make the toner have a sharper charge distribution.

The toner base particles used in the present invention may be produced by using whatever method, and may preferably be produced by a production process in which granulation is carried out in an aqueous medium, such as suspension polymerization, emulsion polymerization or suspension granulation. The production process in which the toner base particles are obtained by granulation in an aqueous medium enables enclosure of a wax component in the particles without making it present on the surfaces of toner base particles even when the wax component is added to the toner base particles in a large quantity. Of these production processes, the suspension polymerization is one of the most preferred production processes in view of long-term developing stability owing to the enclosure of the wax component in the toner base particles, and in view of production cost such that any solvent is not used. That is, the toner base particles may preferably be toner base particles obtained by dispersing in an aqueous medium a polymerizable monomer composition containing at least a polymerizable monomer and a colorant, and carrying out the granulation to polymerize the polymerizable monomer.

How to produce the toner base particles is described below, taking the case of the suspension polymerization as an example, which is most preferable in order to obtain the toner base particles used in the present invention.

In the suspension polymerization, a colorant and optionally other additives are uniformly dissolved or dispersed in a polymerizable monomer(s) by means of a dispersion machine such as a homogenizer, a ball mill, a colloid mill or an ultrasonic dispersion machine to prepare a polymerizable monomer composition. Next, this polymerizable monomer composition is suspended and dispersed in an aqueous medium containing a dispersion stabilizer, to effect granulation, and the polymerizable monomer composition is polymerized in the presence of a polymerization initiator, whereby the toner base particles are produced. The polymerization initiator may be added at the same time when other additives are added to the polymerizable monomer(s), or may be mixed immediately before the polymerizable monomer composition is suspended in the aqueous medium. A polymerization initiator having been dissolved in the polymerizable monomer or in a solvent may also be added immediately after the granulation or before the polymerization reaction is started.

The binder resin constituting the above toner base particles may include a styrene-acrylic copolymer, a styrene-methacrylic copolymer, epoxy resins and a styrene-butadiene copolymer, which are commonly used. Thus, as the above polymerizable monomer(s), a vinyl type polymerizable monomer(s) capable of radical polymerization may be used.

As the vinyl type polymerizable monomer(s), a monofunctional polymerizable monomer(s) or a polyfunctional polymerizable monomer(s) may be used.

The polymerizable monomer(s) may include the following: Styrene; styrene monomers such as o-, m- or p-methylstyrene, and m- or p-ethylstyrene; acrylic or methacrylic ester monomers such as methyl acrylate, methyl methacrylate, ethyl acrylate, methyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate and diethylaminoethyl methacrylate; and olefin monomers such as butadiene, isoprene, cyclohexene, acrylonitrile, methacrylonitrile, acrylic acid amide and methacrylic acid amide.

Any of these polymerizable monomers may be used alone or may commonly be used in the form of an appropriate mixture of polymerizable monomers which are so mixed that the theoretical glass transition temperature (Tg) as described in a publication POLYMER HANDBOOK, 2nd Edition, III-pp. 139-192 (John Wiley & Sons, Inc.) shows from 40° C. or more to 75° C. or less. If the theoretical glass transition temperature is less than 40° C., a problem may arise in view of the storage stability or running stability of the toner. If on the other hand it is more than 75° C., the toner may have a low fixing performance.

In producing the toner base particles used in the toner of the present invention, a low-molecular weight polymer may be added. The low-molecular weight polymer may be added to the polymerizable monomer composition when the toner base particles are produced by the suspension polymerization. As the low-molecular weight polymer, it may preferable be one having weight average molecular weight (Mw) in the range of from 2,000 or more to 5,000 or less and an Mw/Mn of less than 4.5, and preferably less than 3.0, as measured by gel permeation chromatography (GPC).

The low-molecular weight polymer may include as examples thereof a low-molecular weight polystyrene, a low-molecular weight styrene-acrylate copolymer and a low-molecular weight styrene-methacrylate copolymer.

The low-molecular weight polymer may preferably be added in an amount of from 1 part by mass or more to 50 parts by mass or less, and much preferably 5 parts by mass or more to 30 parts by mass or less, based on 100 parts by mass of the binder resin.

In the present invention, a polar resin having a carboxyl group, such as a polyester resin or a polycarbonate resin may be used in combination with the binder resin described above.

For example, in the case when the toner base particles are directly produced by the suspension polymerization, the polar resin may be added at any time of polymerization reaction of from the step of dispersion up to the step of polymerization, whereby the state of presence of the polar resin can be so controlled that, according to a balance between polarities the polymerizable monomer composition which is to make the toner base particles and the aqueous dispersion medium take on, the polar resin added may form thin layers on the surfaces of the toner base particles or may come present with a gradient from surfaces toward centers of the toner base particles.

The polar resin may preferably be added in an amount of from 1 part by mass or more to 25 parts by mass or less, and much preferably from 2 parts by mass or more to 15 parts by mass or less, based on 100 parts by mass of the binder resin. As long as its amount is within this range, shell layers with an appropriate layer thickness can be formed.

The polar resin used in the present invention may include polyester resins, epoxy resins, a styrene-acrylic acid copolymer, a styrene-methacrylic acid copolymer and a styrene-maleic acid copolymer. In particular, as the polar resin, a polyester resin having main peak molecular weight in the range of molecular weight of from 3,000 or more to 10,000 or less is preferred as enabling the toner base particles to be improved in fluidity and negative triboelectric charge characteristics.

Further, as the polar resin used in the present invention, it may be a polyester resin produced in the presence of a titanium compound as a catalyst. This is preferable because the effect aimed in the present invention can be brought out with ease.

In the present invention, in order to enhance the mechanical strength of the toner base particles and also control the molecular weight of a THF-soluble component of the toner, a cross-linking agent may also be used when the binder resin is synthesized.

As a bifunctional cross-linking agent, it may include the following: Divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol silica titania composite particles00 diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates (MANDA; available from Nippon Kayaku Co., Ltd.), and the above diacrylates each acrylate moiety of which is replaced with methacrylate.

As a polyfunctional cross-linking agent, it may include the following: Pentaerythritol triacrylate, trimethylolethane triacrylate, trimethylolpropane triacrylate, tetramethylolmethane tetraacrylate, oligoester acrylate, and methacrylates of these, and also 2,2-bis(4-methaoryloxy-polyethoxyphenyl)propane, diallyl phthalate, triallyl cyanurate, triallyl isocyanurate and triallyl trimellitate.

Any of these cross-linking agents may preferably be added in an amount of from 0.05 part by mass or more to 10 parts by mass or less, and much preferably from 0.1 part by mass or more to 5 parts by mass or less, based on 100 parts by mass of the polymerizable monomer(s).

As the polymerization initiator, it may include the following: Azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide and tert-butyl-peroxypivarate.

Any of these polymerization initiators may commonly be added in an amount of from 3 parts by mass or more to 20 parts by mass or less, based 100 parts by mass of the polymerizable monomer(s), which may vary depending on the intended degree of polymerization. The polymerization initiator may a little differ in type depending on methods for polymerization, and may be used alone or in the form of a mixture, making reference to its 10-hour half-life period temperature.

The toner of the present invention contains a colorant. A colorant used preferably in the present invention may include the following organic pigments, organic dyes and inorganic pigments.

Organic pigments or organic dyes usable as cyan colorants may include copper phthalocyanine compounds and derivatives thereof, anthraquinone compounds and basic dye lake compounds. Stated specifically, they may include the following: C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As organic pigments or organic dyes usable as magenta colorants, they may include the following: Condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include the following: C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Organic pigments or organic dyes usable as yellow colorants may include compounds typified by condensation azo compounds, isoindolinone compounds, anthraquinone compounds, azo metal complexes, methine compounds and allylamide compounds. Stated specifically, they may include the following: C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

As black colorants, they may include carbon black and colorants toned in black by the use of yellow, magenta and cyan colorants shown above.

Any of these colorants may be used alone, in the form of a mixture, or further in the state of a solid solution. The colorant used in the toner of the present invention is selected taking account of hue angle, chroma, brightness, light-fastness, transparency on OHP films and dispersibility in toner base particles.

The colorant may be used in its addition in an amount of from 1 part by mass or more to 20 parts by mass or less, based on 100 parts by weight of the binder resin.

In the present invention, in the case when the toner base particles are obtained by the polymerization process, attention must be paid to polymerization inhibitory action or aqueous-phase transfer properties inherent in the colorant. The colorant may preferably be beforehand subjected to hydrophobic treatment with a material free from any polymerization inhibition. In particular, most dye type colorants and carbon black have the polymerization inhibitory action and hence care must be taken when used.

A method for controlling such polymerization inhibitory action of the dye type colorants may include a method in which the polymerizable monomer(s) is/are beforehand polymerized in the presence of any of these dyes. The resultant colored polymer may be added to the polymerizable monomer composition.

With regard to the carbon black, besides the same treatment as that on the dye type colorants, it may be treated with a material capable of reacting with surface functional groups of the carbon black, as exemplified by polyorganosiloxane.

The wax component to be contained in the toner base particles may preferably include hydrocarbon waxes. As the other wax components, they may include the following: Amide waxes, higher fatty acids, long-chain alcohols, ketone waxes, ester waxes, and derivatives thereof such as graft compounds or block compounds of these. Two or more types of waxes may optionally used in combination.

The hydrocarbon wax may include the following: Petroleum waxes and derivatives thereof such as paraffin wax, microcrystalline wax and petrolatum; Fischer-Tropsch wax obtained by Fischer-Tropsch synthesis, and derivatives thereof; polyolefin waxes such as polyethylene wax and polypropylene wax, and derivatives thereof. The derivatives include oxides, block copolymers with vinyl monomers, and graft modified products. It may further include hardened caster oil and derivatives thereof, vegetable waxes, and animal waxes. Any of these wax components may be used alone or in combination of two or more types.

Of these, where the hydrocarbon wax obtained by Fischer-Tropsch synthesis is used, the toner can well maintain its developing performance especially in contact development and, in addition thereto, can well retain high-temperature anti-offset properties. To any of these hydrocarbon waxes, an antioxidant may be added as long as it does not affect the chargeability of the toner.

The wax component may preferably be in a content of from 4.0 parts by mass or more to 25 parts by mass or less, and much preferably from 5.0 parts by mass or more to 15 parts by mass or less, based on 100 parts by mass of the binder resin.

Further, the wax component may preferably have maximum endothermic peak temperature in the range of from 60° C. or more to 120° C. or less, much preferably from 62° C. or more to 110° C. or less, and further preferably from 65° C. or more to 90° C. or less, in a DSC curve at the time of heating, as measured with a differential scanning calorimeter (DSC).

As the dispersion stabilizer used when the above aqueous medium is prepared, any known inorganic and organic dispersion stabilizers may by used.

Stated specifically, the inorganic dispersion stabilizer may include as examples thereof the following: Tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. The organic dispersion stabilizer may include the following: Polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used. Such a surface active agent may include the following: Sodium dodecyl sulfate, sodium tetradecyl sulfate, sodium pentadecyl sulfate, sodium octyl sulfate, sodium oleate, sodium laurate, potassium stearate and calcium oleate. As the dispersion stabilizer, an inorganic sparingly water-soluble dispersion stabilizer is preferred, and yet it is preferable to use a sparingly water-soluble dispersion stabilizer that is soluble in acid.

Where the aqueous medium is prepared, the aqueous medium may preferably be prepared using water in an amount of from 300 parts by mass or more to 3,000 parts by mass or less, based on 100 parts by weight of the polymerizable monomer composition. The dispersion stabilizer may also preferably be used in an amount of from 0.2 part by mass or more to 2.0 parts by mass or less, based on 100 parts by weight of the polymerizable monomer(s).

In the present invention, where the aqueous medium in which the sparingly water-soluble inorganic dispersion stabilizer has been dispersed as described above is prepared, it may be dispersed using a commercially available dispersion stabilizer as it is. Also, in order to obtain particles of the dispersion stabilizer which have a fine and uniform particle size, the inorganic dispersion stabilizer may be formed in a liquid medium such as water under high-speed agitation to prepare the aqueous medium. For example, where tricalcium phosphate is used as the dispersion stabilizer, an aqueous sodium phosphate solution and an aqueous calcium chloride solution may be mixed under high-speed agitation to form fine particles of the tricalcium phosphate, whereby a preferable dispersant can be obtained.

In the toner of the present invention, it may optionally be incorporated with a charge control agent. The incorporation with a charge control agent enables stabilization of charge characteristics and control of optimum triboelectric charge quantity in conformity with the development system.

As the charge control agent, any known charge control agent may be used. In particular, charge control agents which can give speedy charging and also can maintain a constant charge quantity stably are preferred. Further, where the toner base particles are directly produced by polymerization, it is particularly preferable to use charge control agents having a low polymerization inhibitory action and being substantially free of any solubilizate to the aqueous medium.

The charge control agent may include, as charge control agents capable of controlling the toner to be negatively chargeable, the following: Organic metal complexes or chelate compounds, which are effective, monoazo metal compounds, acetylacetone metal compounds, hydroxycarboxylic acid metal compounds, and dicarboxylic acid metal compounds. Besides, it may also include aromatic hydroxycarboxylic acids, aromatic monocarboxylic acids, and polycarboxylic acids, and metal salts, anhydrides or esters thereof, as well as phenolic derivatives such as bisphenol. It may further include urea derivatives, metal-containing salicylic acid compounds, metal-containing naphthoic acid compounds, boron compounds, quaternary ammonium salts, carixarene, and resin type charge control agents.

It may also include, as charge control agents capable of controlling the toner to be positively chargeable, the following; Nigrosine and Nigrosine-modified products, modified with a fatty acid metal salt or the like; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; and resin type charge control agents.

The toner of the present invention may contain any of these charge control agents alone or in combination of two or more types.

Of these charge control agents, in order to sufficiently bring out the effect aimed in the present invention, metal-containing salicylic acid compounds are preferred. In particular, as their metal, aluminum or zirconium is preferred. As the most preferred control agent, it is a 3,5-di-tert-butylsalicylic acid aluminum compound.

The charge control agents may preferably be mixed in an amount of from 0.01 part by mass or more to 20 parts by mass or less, and much preferably from 0.5 part by mass or more to 10 parts by mass or less, based on 100 parts by mass of the polymerizable monomer(s) or binder resin. However, the addition of the charge control agent is not essential in the toner of the present invention. The triboelectric charging between the toner and the toner layer thickness control member and developer carrying member may actively be utilized, and this make it not always necessary for the toner to be incorporated with the charge control agent.

To the toner particles in the present invention, in combination with the silica titania composite particles described in the present invention, other inorganic fine powder may be added as a fluidity improver.

Such an inorganic fine powder that may be added to the toner particles used in the present invention may include fine silica powder, fine titania powder and fine alumina powder, or fine double oxide powders of any of these. As the inorganic fine powder, fine silica powder or fine titanium oxide powder is preferred, and it is particularly preferable to use hydrophobic-treated fine silica powder. Incorporation of the hydrophobic-treated fine silica powder brings an improvement in dispersibility of the fine alumina powder and silica titania composite particles on the toner base particle surfaces, to provide a state in which the effect aimed in the present invention can be brought out with ease. In particular, it is preferable to add hydrophobic-treated fine silica powders having different BET specific surface area. In such a case, it is preferable that one of these powders has a BET specific surface area of from 60 $m^2/g$ to 150 $m^2/g$ and the other has a BET specific surface area of from 40 $m^2/g$ to 60 $m^2/g$. In the case when the toner particles have such two kinds of hydrophobic-treated fine silica powders having different BET specific surface area, the toner is further improved in fluidity and dispersibility as being preferable.

It is preferable for the inorganic fine powder to be externally added to the toner base particles in order to improve the fluidity of the toner and make the toner particles uniformly chargeable. Further, the hydrophobic treatment of the inorganic fine powder enables the toner to be controlled for its charge quantity, improved in its environmental stability and improved in its properties in a high-humidity environment, and hence it is much preferable to use the hydrophobic-treated inorganic fine powder. Where the inorganic fine powder added to the toner particles has moistened, the charge quantity required as the toner may lower to tend to cause a lowering of developing performance and transfer performance.

As a treating agent for the hydrophobic treatment of the inorganic fine powder, it may include treating agents such as an unmodified silicone varnish, a modified silicone varnish of various types, a modified silicone oil, a modified silicone oil of various types, silane compounds, silane coupling agents, other organosilicon compounds, and organotitanium compounds. Any of these treating agents may be used alone or in combination.

As image forming methods making use of the toner of the present invention, there are no particular limitations thereon as long as they are image forming methods having the step of forming a toner image making use of the toner of the present invention. An example thereof is shown below.

FIG. 1 is a sectional view schematically showing the construction of an image forming apparatus making use of a process cartridge having the toner of the present invention. In the image forming apparatus shown in FIG. 1, an all-in-one process cartridge 4 consisting chiefly of i) a developing assembly 10 having a toner carrying member 6, a toner coating member 7, a toner 8 which is the toner of the present invention and a toner coat control member 9 and ii) a photosensitive drum 5, a cleaning blade 14, a waste toner holding container 13 and a charging member 12 is detachably mounted to the main body of the apparatus. The photosensitive drum 5 is rotated in the direction of an arrow, and is uniformly electrostatically charged by the charging member 12, which is to put the photosensitive drum 5 to electrostatic charging. The surface of the photosensitive drum 5 thus charged is exposed to laser light 11 which is an exposure means by which an electrostatic latent image is written on the photosensitive drum 5, thus the electrostatic latent image is formed on its surface. The electrostatic latent image is provided with the toner of the present invention by means of the developing assembly 10, which is disposed in contact with the photosensitive drum 5, and is thereby developed and rendered visible as a toner image.

The toner image thus rendered visible and held on the photosensitive drum 5 is transferred to a recording medium, a paper sheet 22, by the aid of a transfer member, a transfer roller 17. The paper sheet 22 to which the toner image has been transferred is put to fixing by means of a fixing assembly 15, and then put out of the apparatus. Thus, one print operation is completed.

Meanwhile, any transfer residual toner not transferred from and having remained on the photosensitive drum 5 is scraped off by means of the cleaning blade 14, which is a cleaning member for cleaning the photosensitive drum surface, and is collected in the waste toner holding container 13. On the photosensitive drum 5 thus cleaned, the above operation is repeated.

The developing assembly 10 has i) a developer container holding therein the toner 8, the toner carrying member 6, which is positioned at an opening that extends in the developer container in its lengthwise direction and which is disposed facing the photosensitive drum 5, and ii) the toner coat control member 9, and is so set as to develop the electrostatic latent image on the photosensitive drum 5 to render it visible. In FIG. 1, reference numeral 16 denotes a drive roller; 17, a transfer roller; 18, a bias power source; 19, a tension roller; 20, a transfer transport belt; 21, a follower roller; 22, a paper sheet; 23, a sheet feed roller; and 24, an attraction roller.

A developing process in the developing assembly 10 is described below. The toner is coated on the toner carrying member 6 by the aid of the toner coating member 7, which is rotatingly supported. The toner thus coated on the toner carrying member 6 is rubbed against the toner coat control member 9 as the toner carrying member 6 is rotated. The toner carrying member 6 comes into contact with the photosensitive drum 5 while being rotated, where the electrostatic latent image formed on the photosensitive drum 5 is developed with the toner having been coated on the toner carrying member 6, thus the toner image is formed.

In the image forming method making use of the toner of the present invention, a bias may be applied to the toner coat control member 9, and this is preferable in order to make uniform the coating of the toner on the toner carrying member 6. The bias to be applied has the same polarity as the charge polarity of the toner, and it is common for its voltage to be a voltage higher by tens of volts to hundreds of volts than the development bias. Where the bias is applied to the toner coat control member 9 in this way, it is preferable for the toner coat control member 9 to be electrically conductive, and is much preferable to be made of a metal such as phosphor bronze or stainless steel.

How to measure the content and physical properties that are specified in the present case is shown below.

Measurement of Content of Silica in Silica Titania Composite Particles (Untreated)

Measurement of each element is made by X-ray fluorescence according to JIS K 0119-1969. Stated specifically, it is as described below.

A wavelength dispersion type X-ray fluorescence analyzer "AXIOS" (manufactured by PANalytical B.V.) is used as a measuring instrument, and software attached thereto for its exclusive use "Super Q Ver.4.0F (available from PANalytical B.V.) is also used which is to set conditions for measurement and analyze the measured data. Here, an Rh anode tube is used as the anode of an X-ray anode tube, measurement is made in an atmosphere of vacuum, measurement diameter (the diameter of a collimator mask) is set at 27 mm, and measurement time is set at 10 seconds. Also, in measuring any light elements, they are detected with a proportional counter (PC), and, in measuring any heavy elements, with a scintillation counter (SC).

As a material for a measuring sample, a material is used which is obtained by adding the silica titania composite particles (untreated) to low-molecular weight polyethylene in such an amount that the former is 1.0 part by mass based on 100 parts by mass of the latter and mixing them thoroughly by using a coffee mill. As the measuring sample, a pellet is used which is obtained by putting about 4 g of the measuring sample material in an aluminum ring for pressing for its exclusive use, leveling the material and pressing it at 20 MPa for 60 seconds by means of a pelleting pressing machine "BRE-32" (manufactured by Maekawa Testing Machine Mfg. Co., Ltd.) so as to be molded in a size of about 2 mm in thickness and about 39 mm in diameter.

The measurement is made under the above conditions, and elements are identified on the bases of X-ray peak positions obtained, where their concentrations are calculated from the counting rate (unit: cps) that concerns the number of X-ray photons per unit time, and the silica content (proportion) is calculated from a calibration curve prepared in the following way.

Preparation of Calibration Curve of Silica

Fine silica powder is added to low-molecular weight polystyrene in such an amount that the former is 0.10 part by mass based on 100 parts by mass of the latter, and these are thoroughly mixed by using a coffee mill. The fine silica powder is likewise mixed with the low-molecular weight polystyrene in such an amount that the former is 0.20 part by mass and 0.50 part by mass each. These are used as samples for the calibration curve.

About the respective samples, pellets of samples for the calibration curve are prepared as described above, by means of the pelleting pressing machine, and the counting rate (unit: cps) of Si—K$\alpha$ rays that is observed at diffraction angle ($2\theta$)=109.08° when PET crystals are used as analyzing crystals. In this measurement, the accelerating voltage and current value of an X-ray generator are set at 24 kV and 100 mA, respectively. The counting rate of X-rays that has been found is taken as ordinate and the content of silica in each sample for the calibration curve is taken as abscissa to obtain a calibration curve of linear function.

Preparation of Calibration Curve of Titania

Fine titanium dioxide powder is added to low-molecular weight polyethylene in such an amount that the former is 0.10 part by mass based on 100 parts by mass of the latter, and these are thoroughly mixed by using a coffee mill. The fine titanium dioxide powder is likewise mixed with the toner particles in such an amount that the former is 0.20 part by mass and 0.50 part by mass each. These are used as samples for the calibration curve.

About the respective samples, pellets of samples for the calibration curve are prepared as described above, by means of the pelleting pressing machine, and the counting rate (unit: cps) of Ti—Kα rays that is observed at diffraction angle (2θ)=86.11° when LiF(200) crystals are used as analyzing crystals. In this measurement, the accelerating voltage and current value of an X-ray generator are set at 40 kV and 60 mA, respectively. The counting rate of X-rays that has been found is taken as ordinate and the content of titania in each sample for the calibration curve is taken as abscissa to obtain a calibration curve of linear function.

Measurement of X-Ray Diffraction of Silica Titania Composite Particles

The X-ray diffraction of the silica titania composite particles is measured with a powder X-ray diffraction apparatus "RINT TRII" (manufactured by Rigaku Corporation) is used to make measurement. Also, the proportion of the anatase type to the rutile type is calculated by using analytical software "JADE 6" attached to the apparatus.

A measuring sample is put on a non-reflective sample plate (available from Rigaku Corporation) not having any diffraction peak in the measurement range, holding down the sample in such a way that its surface may become flat as it stands powdery. If it is strongly held down, there is a possibility that crystals come oriented to make any correct area ratio not calculable. After its surface has become flat, the sample is set in the apparatus together with its plate.

Measurement Conditions

Anode tube: Cu
Parallel beam optical system
Voltage: 50 kv
Current: 300 mA
Start angle: 10°
End angle: 40°
Sampling width: 0.2°
Scanning speed: 4.00°/min.
Divergence slit: open
Divergence vertical slit: 10 mm
Scattering slit: open
Receiving slit: open First, the peaks located are processed for peak separation by using the software "JADE 6" attached to the apparatus.

For example, where the peaks located are only those for silica and titania, sharp crystalline peaks at around 2θ=25° (anatase) and at around 2θ=27° (rutile), beforehand assigned by the beak search, and a broad amorphous peak having peaks at around 2θ=20° to 23° are specified, and thereafter the peak separation may be performed by automatic fitting. In this peak separation, the area of crystal peaks can not correctly be calculated unless the amorphous portion is processed, thus care must be taken.

Among peak data obtained by the above operation, the area of the anatase peak at 2θ=25° and that of the rutile peak at 2θ=27° are compared to determine their area ratio.

Measurement of Hydrophilicity of Silica Titania Composite Particles

First, 40 ml of a water-containing methanol solution composed of 40% by volume of methanol and 60% by volume of water is put into a cylindrical glass container of 5 cm in diameter and 1.75 mm in wall thickness, and then put to dispersion for 5 minutes by means of an ultrasonic dispersion machine in order to remove any air bubbles and so forth included in this solution for measurement.

Next, 0.1 g of the silica titania composite particles are precisely weighed out, and put into the container holding the water-containing methanol solution to prepare a sample solution for measurement.

Then, the sample solution for measurement is set in a powder wettability tester "WET-100P" (manufactured by RHESKA Company Limited). This sample solution for measurement is stirred at a speed of 5.0 $S^{-1}$ (300 rpm) by means of a magnetic stirrer. Here, as a rotor of the magnetic stirrer, a spindle-shaped rotor is used which has been coated with a fluorine resin and is 25 mm in length and 8 mm in maximum diameter at its middle.

Next, to this sample solution for measurement, methanol is continuously dropwise added at a rate of addition of 0.8 ml/min through the above apparatus, during which the sample solution is irradiated with light of 780 nm in wavelength to measure its transmittance to prepare a transmittance curve of the methanol added dropwise, where the methanol concentration at the end point where the transmittance has come minimal is taken as the hydrophilicity.

Measurement of Volume Resistivity of Silica Titania Composite Particles

Figure 2:
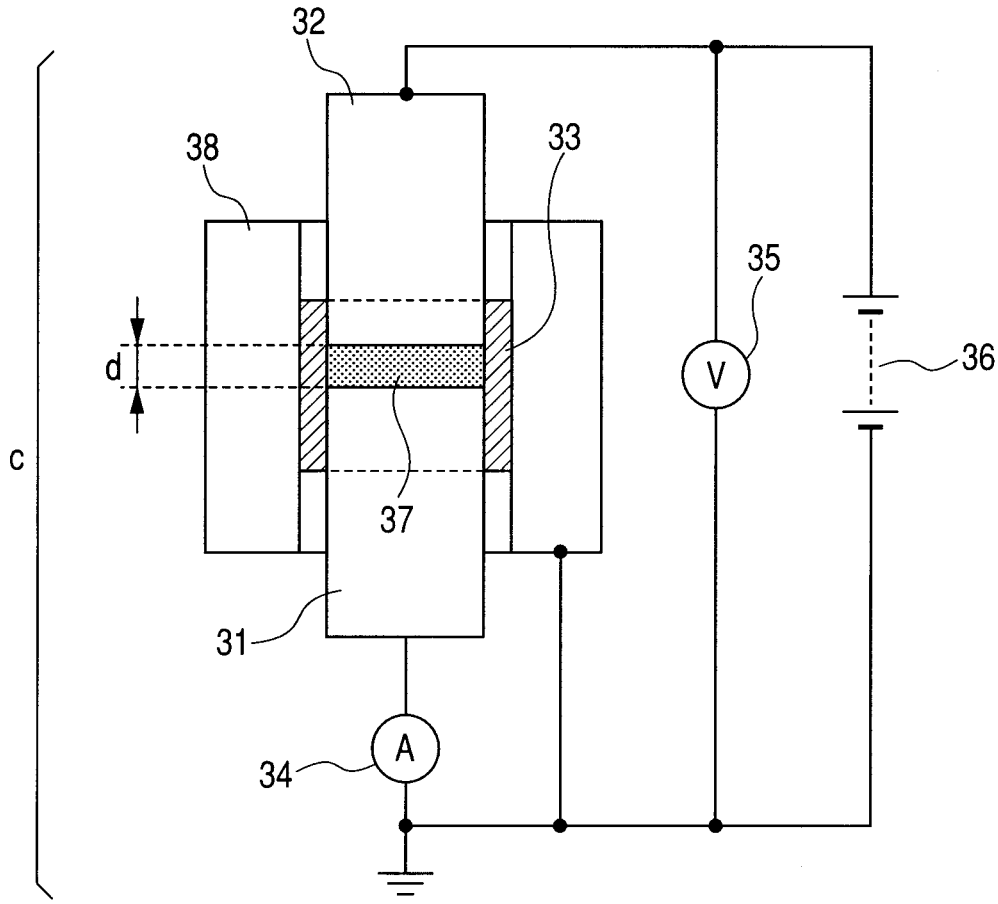
FIG. 2 is a schematic illustration of an instrument for measuring volume resistivity.

An instrument for measuring the volume resistivity of the silica titania composite particles used in the present invention is shown in FIG. 2. In the measuring instrument shown in FIG. 2, reference numeral 31 denotes a lower electrode; 32, an upper electrode; 33, an insulating material; 34, an ammeter; 35, a voltmeter; 36, a constant-voltage device; 37, the silica titania composite particles to be measured; 38, a guide ring; and C, a resistivity measuring cell. The cell A is packed with the silica titania composite particles. A method is used in which the lower and upper electrodes 31 and 32 are so provided as to come into contact with the silica titania composite particles thus packed, where a voltage is applied across these electrodes and the currents flowing at that time are measured to determine the volume resistivity. In this measuring method, since the silica titania composite particles are a powder, a change may occur in a packing and the volume resistivity may change correspondingly thereto in some cases, thus care must be taken. The measurement of volume resistivity in the present invention is made under conditions of a contact area S between the silica titania composite particles packed and the electrodes, of about 2.3 $cm^2$, a thickness d of about 1.0 mm or more to 1.5 mm or less, a load of the upper electrode 32 of 180 g. Also, as applied voltage, the applied voltage is raised by 200 V each at intervals of 30 seconds, where the specific resistance measured when a voltage of 1,000 V is applied is taken as the volume resistivity in the present invention.

Measurement of BET Value of Silica Particles

The BET specific surface area is measured according to JIS Z8830 (2001).

As a measuring instrument, an automatic specific surface area/pore distribution measuring instrument "TriStar 3000" (manufactured by Shimadzu Corporation) is used, which employs as a measuring system a gas adsorption method based on a constant-volume method. The measurement is made according to "TriStar 3000 Manual V4.0" attached to the instrument. The setting of conditions for the measurement and the analysis of measured data are performed by using software "TriStar 3000 Version 4.00" attached to the instrument for its exclusive use. A vacuum pump, a nitrogen gas feed pipe and a helium gas feed pipe are also connected to the instrument. Nitrogen gas is used as adsorption gas, and the value calculated by the BET multi-point method is taken as the BET specific surface area referred to in the present invention.

Measurement of Content of Titanium Element in Toner Base Particles

Measurement of each element is made by X-ray fluorescence according to JIS K 0119-1969. Stated specifically, it is as described below.

A wavelength dispersion type X-ray fluorescence analyzer "AXIOS" (manufactured by PANalytical B.V.) is used as a measuring instrument, and software attached thereto for its exclusive use "Super Q Ver.4.0F (available from PANalytical B.V.) is also used which is to set conditions for measurement and analyze the measured data. Here, an Rh anode tube is used as the anode of an X-ray anode tube, measurement is made in an atmosphere of vacuum, measurement diameter (the diameter of a collimator mask) is set at 27 mm and measurement time is set at 10 seconds. Also, in measuring any light elements, they are detected with a proportional counter (PC), and, in measuring any heavy elements, with a scintillation counter (SC).

As a measuring sample, a pellet is used which is obtained by putting about 4 g of the toner base particles in an aluminum ring for pressing for its exclusive use, leveling the particles and pressing them at 20 MPa for 60 seconds by means of a pelleting pressing machine "BRE-32" (manufactured by Maekawa Testing Machine Mfg. Co., Ltd.) so as to be molded in a size of about 2 mm in thickness and about 39 mm in diameter.

The measurement is made under the above conditions, and the element is identified on the basis of X-ray peak position obtained, where its concentration is calculated from the counting rate (unit: cps) that concerns the number of X-ray photons per unit time.

Measurement of Number Average Particle Diameter (D1) of Silica Titania Composite Particles The number average particle diameter (D1) of the silica titania composite particles is measured with a transmission electron microscope (TEM). Stated specifically, the silica titania composite particles are photographed at 200,000 magnifications, and such an enlarged photograph is observed as a measuring object. Diameters of any arbitrary 1,000 particles are measured, and their average value is taken as the number average particle diameter (D1).

EXAMPLES

The present invention is described below in greater detail by giving production examples and working examples. These, however, by no means limit the present invention.

Polyester Resin Production Examples

Production of Aromatic Carboxylic Acid Titanium Compound A

In a 4-liter four-necked flask made of glass, to which a thermometer, a stirring rod, a condenser and a nitrogen feed pipe were attached and which was placed in a mantle heater, 65.3 parts by mass of terephthalic acid and 18 parts of ethylene glycol were mixed, and these were dissolved at a temperature of 100° C., followed by dehydration under reduced pressure. Thereafter, after cooling to 50° C., 17.2 parts by mass of titanium tetramethoxide was added in an atmosphere of nitrogen. Thereafter, the inside of the flask was evacuated and a reaction product methanol was evaporated out to obtain an aromatic carboxylic acid titanium compound A.

Production Example 1 of Polyester Resin 2.75 moles of polyoxypropylene(2.2)-2,2-bis(4-hydroxyphenyl)propane, 1.0 mole of polyoxyethyiene(2.2)-2,2-bis(4-hydroxyphenyl)propane, 6.1 moles of isophthalic acid and 0.15 mole of trimellitic anhydride were weighed out. Then, 100 parts by mass of these acids and alcohols and 0.27 part by mass of the aromatic carboxylic acid titanium compound A were put into a 4-liter four-necked flask made of glass, and a thermometer, a stirring rod, a condenser and a nitrogen feed tube were attached thereto. This flask was placed in a mantle heater. In an atmosphere of nitrogen, the reaction was carried out at 220° C. At the time the reaction mixture came to have an acid value of 13 mgKOH/g, its heating was stopped to allow it to cool gradually to obtain a polyester resin 1. This resin had a hydroxyl value of 20 mgKOH/g, an Mw of 8,000, an Mn of 3,500 and a Tg of 70.0° C.

Production Example 2 of Polyester Resin 2.75 moles of polyoxypropylene(2.2)-2,2-bis(4-hydroxyphenyl)propane, 1.0 mole of polyoxyethylene(2.2)-2,2-bis(4-hydroxyphenyl)propane, 6.1 moles of isophthalic acid and 0.15 mole of trimellitic anhydride were weighed out. Then, 100 parts by mass of these acids and alcohols and 3.00 parts by mass of the aromatic carboxylic acid titanium compound A were put into a 4-liter four-necked flask made of glass, and a thermometer, a stirring rod, a condenser and a nitrogen feed tube were attached thereto. This flask was placed in a mantle heater. In an atmosphere of nitrogen, the reaction was carried out at 220° C. At the time the reaction mixture came to have an acid value of 13 mgKOH/g, its heating was stopped to allow it to cool gradually to obtain a polyester resin 2 having a polyester unit component. This resin had a hydroxyl value of 20 mgKOH/g, an Mw of 7,500, an Mn of 3,300 and a Tg of 68.0° C.

Production Example 3 of Polyester Resin 2.75 moles of polyoxypropylene(2.2)-2,2-bis(4-hydroxyphenyl)propane, 1.0 mole of polyoxyethylene(2.2)-2,2-bis(4-hydroxyphenyl)propane, 6.1 moles of isophthalic acid and 0.15 mole of trimellitic anhydride were weighed out. Then, 100 parts by mass of these acids and alcohols and 0.27 part by mass of dibutyltin oxide were put into a 4-liter four-necked flask made of glass, and a thermometer, a stirring rod, a condenser and a nitrogen feed tube were attached thereto. This flask was placed in a mantle heater. In an atmosphere of nitrogen, the reaction was carried out at 220° C. At the time the reaction mixture came to have an acid value of 13 mgKOH/g, its heating was stopped to allow it to cool gradually to obtain a polyester resin 3 having a polyester unit component. This resin had a hydroxyl value of 20 mgKOH/g, an Mw of 7,800, an Mn of 3,400 and a Tg of 69.0° C.

Production of Silica Titania Composite Particles

Production Example 1 of Silica Titania Composite Particles

The flow rate of and nozzle for each of silicon tetrachloride gas and titanium tetrachloride gas were so controlled that the silicon tetrachloride gas and the titanium tetrachloride gas were sprayed at such flow rates as to be in a proportion of 70.0:30.0 and in the state of fine droplets. Each of the silicon tetrachloride gas and the titanium tetrachloride gas was sprayed and introduced through the nozzle into oxygen-hydrogen flame of 1,200° C. in flame temperature to make high-temperature hydrolysis take place to form silica titania composite particles, which were then cooled and thereafter collected through a filter. The content of silica in the particles collected and the value of Xa/Xb thereof were measured. The results of measurement are shown in Table 1.

100 parts by mass of the above silica titania composite particles were put into an agitator and, while being agitated, 20 parts by mass of dimethylsilicone oil (viscosity: 50 cSt) were sprayed thereon by means of a twin-spray nozzle to make it adhere to the silica titania composite particles.

Such agitation treatment was further continued for 60 minutes, followed by cooling. Thereafter, the composite particles obtained were put to disintegration treatment to obtain silica titania composite particles No. 1 having been surface-treated with the dimethylsilicone oil. The hydrophobicity of the silica titania composite particles No.1 thus obtained was measured. The results of measurement are shown in Table 1.

Production Example 2 of Silica Titania Composite Particles

Silica titania composite particles No. 2 were obtained in the same way as in the above Silica Titania Composite Particles Production Example 1 except that the amount of the dimethylsilicone oil (viscosity: 50 cSt) was changed to 15 parts by mass. Their physical properties are shown in Table 1.

Production Example 3 of Silica Titania Composite Particles

Silica titania composite particles No. 3 were obtained in the same way as in the above Silica Titania Composite Particles Production Example 1 except that the amount of the dimethylsilicone oil (viscosity: 50 cSt) was changed to 25 parts by mass. Their physical properties are shown in Table 1.

Production Example 4 of Silica Titania Composite Particles

Silica titania composite particles No. 4 were obtained in the same way as in the above Silica Titania Composite Particles Production Example 1 except that the flame temperature in making the high-temperature hydrolysis was changed to 1,000° C. Their physical properties are shown in Table 1.

Production Example 5 of Silica Titania Composite Particles

Silica titania composite particles No. 5 were obtained in the same way as in the above Silica Titania Composite Particles Production Example 1 except that the flame temperature in making the high-temperature hydrolysis was changed to 1,500° C. Their physical properties are shown in Table 1.

Production Example 6 of Silica Titania Composite Particles

Silica titania composite particles No. 6 were obtained in the same way as in the above Silica Titania Composite Particles Production Example 1 except that the surface treatment with dimethylsilicone oil was not carried out. Their physical properties are shown in Table 1. Incidentally, the silica titania composite particles No. 6 were well dispersible in water, and hence their hydrophobicity was regarded as 0%.

Production Example 7 of Silica Titania Composite Particles

Silica titania composite particles No. 7 were obtained in the same way as in the above Silica Titania Composite Particles Production Example 1 except that the amount of the dimethylsilicone oil (viscosity: 50 cSt) was changed to 10 parts by mass. Their physical properties are shown in Table 1.

Production Example 8 of Silica Titania Composite Particles

Silica titania composite particles No. 8 were obtained in the same way as in the above Silica Titania Composite Particles Production Example 1 except that the amount of the dimethylsilicone oil (viscosity: 50 cSt) was changed to 35 parts by mass. Their physical properties are shown in Table 1.

Production Example 9 of Silica Titania Composite Particles

Silica titania composite particles No. 9 were obtained in the same way as in the above Silica Titania Composite Particles Production Example 1 except that the amount of the silicon tetrachloride gas and that of the titanium tetrachloride gas were changed to 58.0 parts by mass and 42.0 parts by mass, respectively. Their physical properties are shown in Table 1.

Production Example 10 of Silica Titania Composite Particles

Silica titania composite particles No. 10 were obtained in the same way as in the above Silica Titania Composite Particles Production Example 1 except that the amount of the silicon tetrachloride gas and that of the titanium tetrachloride gas were changed to 83.0 parts by mass and 17.0 parts by mass, respectively. Their physical properties are shown in Table 1.

Production Example 11 of Silica Titania Composite Particles 58.0 parts by mass of silica sol having a BET specific surface area of 120 $m^2/g$, 40.0 parts by mass of titania (anatase) sol having a BET specific surface area of 200 $m^2/g$ and 2.0 parts by mass of titania (rutile) sol were thoroughly mixed by a dry process, followed by dehydration and drying, and further followed by baking at 300° C. for 3 hours to obtain mixed particles. Thereafter, their surface treatment was carried out in the same way as that in Silica Titania Composite Particles Production Example 1 to obtain silica titania composite particles No. 11. Their physical properties are shown in Table 1.

Production Example 12 of Silica Titania Composite Particles

Silica titania composite particles No. 12 were obtained in the same way as in the above Silica Titania Composite Particles Production Example 1 except that the amount of the silicon tetrachloride gas and that of the titanium tetrachloride gas were changed to 50.0 parts by mass and 50.0 parts by mass, respectively, and that the flame temperature in making the high-temperature hydrolysis was changed to 1,100° C. Their physical properties are shown in Table 1.

Production Example 13 of Silica Titania Composite Particles

Silica titania composite particles No. 13 were obtained in the same way as in the above Silica Titania Composite Particles Production Example 1 except that the amount of the silicon tetrachloride gas and that of the titanium tetrachloride gas were changed to 90.0 parts by mass and 10.0 parts by mass, respectively, and that the flame temperature in making the high-temperature hydrolysis was changed to 1,100° C. Their physical properties are shown in Table 1.

Production Example 14 of Silica Titania Composite Particles

Silica titania composite particles No. 14 were obtained in the same way as in the above Silica Titania Composite Particles Production Example 1 except that the flame temperature in making the high-temperature hydrolysis was changed to 850° C. and that the amount of the dimethylsilicone oil (viscosity: 50 cSt) was changed to 5 parts by mass. Their physical properties are shown in Table 1.

Production Example 15 of Silica Titania Composite Particles

Silica titanic composite particles No. 15 were obtained in the same way as in the above Silica Titania Composite Particles Production Example 1 except that the flame temperature in making the high-temperature hydrolysis was changed to 2,300° C. and that the amount of the dimethylsilicone oil (viscosity: 50 cSt) was changed to 5 parts by mass. Their physical properties are shown in Table 1.

Example 1

Based on 100 parts by mass of a styrene monomer, 16.5 parts by mass of C.I. Pigment Blue 15:3 and 3.0 parts by mass of a di-tert-butylsalicylic acid aluminum compound (BONTRON E-88, available from Orient Chemical Industries, Ltd.) were readied. These were introduced into an attritor (manufactured by Mitsui Mining & Smelting Co., Ltd.), and stirred at 200 rpm and 25° C. for 180 minutes by using zirconia beads (140 parts by mass) of 1.25 mm in radius to prepare a master batch dispersion 1.

Meanwhile, in 710 parts by mass of ion-exchanged water, 450 parts by mass of an aqueous 0.1 mol/liter $Na_3PO_4$ solution was introduced, followed by heating to 60° C. Thereafter, to the resultant mixture, 67.7 parts by mass of an aqueous 1.0 mol/liter $CaCl_2$ solution was slowly added to obtain an aqueous medium containing a calcium phosphate compound.

| | |
|---|---|
| Above master batch dispersion 1 | 40 parts by mass |
| Styrene monomer | 52 parts by mass |
| n-Butyl acrylate monomer | 19 parts by mass |
| Low-molecular weight polystyrene (Mw: 3,000; Mn: 1,050; Tg: 55° C.) | 15 parts by mass |
| Hydrocarbon wax (Fischer-Tropsch wax; maximum endothermic peak temperature: 78° C.; Mw: 750) | 9 parts by mass |
| Polyester resin 1 | 5 parts by mass |

The above materials were heated to 63° C. and were uniformly dissolved and dispersed at 5,000 rpm by means of a TK-type homomixer (manufactured by Tokushu Kika Kogyo Co., Ltd.). In the dispersion obtained, 7.0 parts by mass of a 70% toluene solution of a polymerization initiator 1,1,3,3-tetramethylbutyl peroxy-2-ethylhexanoate was dissolved to prepare a polymerizable monomer composition.

This polymerizable monomer composition was introduced into the above aqueous medium and then stirred at 12,000 rpm for 10 minutes by means of the TK-type homomixer at a temperature of 65° C. in an atmosphere of $N_2$ to granulate the polymerizable monomer composition. Thereafter, with stirring using paddle stirring blades, the temperature was raised to 67° C. At the time the conversion of polymerization of polymerizable vinyl monomers reached 90%, an aqueous 0.1 mol/liter sodium hydroxide solution was added to adjust the pH of the aqueous dispersion medium to 9. The temperature was further raised to 85° C. at a heating rate of 40° C./hour to carry out the reaction for 4 hours. After the polymerization reaction was completed, residual monomers of toner base particles were evaporated off under reduced pressure. The aqueous dispersion medium was cooled, and thereafter hydrochloric acid was added to adjust the pH to 1.4, followed by stirring for 6 hours to dissolve the calcium phosphate. The toner base particles were filtered and thereafter washed with water, followed by drying at a temperature of 40° C. for 48 hours to obtain cyan-color toner base particles No.1.

To 100 parts by mass of the toner base particles No. 1 thus obtained, 1.0 part by mass of the silica titania composite particles No. 1, 0.5 part by mass of silica particles A having been hydrophobic-treated with dimethylsilicone oil (BET specific surface area: 75 $m^2/g$) and 0.3 part by mass of silica particles B having been hydrophobic-treated with dimethylsilicone oil (BET specific surface area: 50 $m^2/g$) were put to dry-process mixing at 4,000 rpm for 5 minutes by means of Henschel mixer (FM10C,manufactured by Mitsui Mining & Smelting Co., Ltd.; top blade: Y1 type/bottom blade: So type) to obtain a toner No. 1. Physical properties of the toner No. 1 are shown in Table 1.

Image Evaluation

To make image evaluation, a printer LBP5300, manufactured by CANON INC., was used which was so converted as to have a printing speed of 30 sheets/minute in A4 size. This was also so converted that, in a cartridge to be mounted to LBP5300, its toner coat control member was changed for an SUS stainless steel blade of 8 μm in thickness and that a blade bias of −200 V with respect to the development bias was applicable to the toner coat control member. This conversion cartridge was filled with 150 g of the toner No. 1 and mounted to the cyan station, and dummy cartridges were mounted to the other stations. This printer was used to make the following image evaluation.

Images with a print percentage of 1% were reproduced in each environment of 23° C./55% RH (normal-temperature and normal-humidity environment), 30° C./80% RH (high-temperature and high-humidity environment) and 15° C./10% RH (low-temperature and low-humidity environment). Whether or not any development lines appeared was examined at intervals of 1,000-sheet image reproduction, and images were finally reproduced on 12,000 sheets. Evaluation was made on the development lines and also on fog and transfer performance by the following methods. The above apparatus was also used to make evaluation of image density stability by the method shown below. The results of evaluation are shown in Table 2.

(1) Evaluation on Development Lines

To examine whether or not any development lines appeared, solid images and halftone images were reproduced and the images reproduced were visually observed at intervals of image reproduction on 1,000 sheets to make evaluation up to 12,000-sheet running. The larger the number of sheets at which the development lines begin to appear is, i.e., the later they begin to appear is, the more superior performance the toner has against the development lines.

A: Any development lines do not appear up to 12,000-sheet running.
B: Development lines are seen to have appeared at a point in time of 12,000-sheet running.
C: Development lines are seen to have appeared at a point in time of 11,000-sheet running.
D: Development lines are seen to have appeared at a point in time of 9,000- or 10,000-sheet running.
E: Development lines are seen to have appeared at a point in time not later than 8,000-sheet running.

(2) Evaluation on Image Fog

Immediately after images were reproduced on 12,000 sheets and after the printer was left to stand for 48 hours thereafter, images having a white-background area were reproduced. From a difference between whiteness of the white-background area of the image reproduced (reflectance Ds (%)) and whiteness of a transfer sheet (average reflectance Dr (%)) which were measured with REFLECTOMETER Model TC-6DS (manufactured by Tokyo Denshoku Co., Ltd.), fog density (%) (=Dr (%)−Ds (%)) was calculated to make evaluation on image fog when the running for evaluation was finished. As a filter, an amber light filter was used.

A: Less than 0.5%.
B: From 0.5% or more to less than 1.0%.
C: From 1.0% or more to less than 1.5%.
D: From 1.5% or more to less than 5.0%.
E: 5.0% or more.

(3) Evaluation of Transfer Performance

The transfer efficiency of toner was found from a difference in weight between the weight of toner on photosensitive drum and the weight of toner on transfer sheet, which was found when solid images were reproduced immediately after images were reproduced on 12,000 sheets (the transfer efficiency is regarded as 100% when the toner on photosensitive drum has all been transferred to the transfer sheet).

A: Transfer efficiency is 95% or more.
B: Transfer efficiency is from 90% or more to less than 95%.
C: Transfer efficiency is from 80% or more to less than 90%.
D: Transfer efficiency is from 70% or more to less than 80%.
E: Transfer efficiency is less than 70%.

(4) Evaluation of Image Density Stability

First, the image forming apparatus was left to stand for 24 hours at 30° C./80% RH (high-temperature and high-humidity environment), and thereafter a solid image was reproduced on one sheet. Then, the image forming apparatus was left to stand for 24 hours at 15° C./10% RH (low-temperature and low-humidity environment), and thereafter images with a print percentage of 1% were reproduced on 1,000 sheets and thereafter a solid image was reproduced on one sheet.

A difference in image density of solid images between those reproduced in both the environments was measured to make evaluation according to the following criteria.

A: The difference in image density is 0.10 or less.
B: The difference in image density is more than 0.10 to 0.30 or less.
C: The difference in image density is more than 0.30 to 0.50 or less.
D: The difference in image density is more than 0.50.

Example 2

A toner No. 2 was obtained in the same way as in Example 1 except that the silica titania composite particles No. 1 were changed for the silica titania composite particles No. 2. Using the toner obtained, evaluation was made in the same way as in Example 1. The results of evaluation are shown in Table 2.

Example 3

A toner No. 3 was obtained in the same way as in Example 1 except that the amount of the polyester resin 1 was changed to 3 parts by mass and that the silica titania composite particles No. 1 were changed for the silica titania composite particles No. 2. Using the toner obtained, evaluation was made in the same way as in Example 1. The results of evaluation are shown in Table 2.

Example 4

A toner No. 4 was obtained in the same way as in Example 1 except that the polyester resin 1 was changed for the polyester resin 2 and it was used in an amount of 8 parts by mass and that the silica titania composite particles No. 1 were changed for the silica titania composite particles No. 2. Using the toner obtained, evaluation was made in the same way as in Example 1. The results of evaluation are shown in Table 2.

Example 5

A toner No. 5 was obtained in the same way as in Example 1 except that the polyester resin 1 was changed for the polyester resin 3 and that the silica titania composite particles No. 1 were changed for the silica titania composite particles No. 3. Using the toner obtained, evaluation was made in the same way as in Example 1. The results of evaluation are shown in Table 2.

Example 6

A toner No. 6 was obtained in the same way as in Example 1 except that the polyester resin 1 was changed for the polyester resin 2 and it was used in an amount of 10 parts by mass and that the silica titania composite particles No. 1 were changed for the silica titania composite particles No. 3. Using the toner obtained, evaluation was made in the same way as in Example 1. The results of evaluation are shown in Table 2.

Example 7

A toner No. 7 was obtained in the same way as in Example 1 except that the silica particles A were changed for silica particles having been hydrophobic-treated with dimethylsilicone oil, having a BET value of 60 $m^2/g$, and the silica particles B were changed for silica particles having been hydrophobic-treated with dimethylsilicone oil, having a BET value of 40 $m^2/g$. Using the toner obtained, evaluation was made in the same way as in Example 1. The results of evaluation are shown in Table 2.

Example 8

A toner No. 8 was obtained in the same way as in Example 1 except that the silica particles A were changed for silica particles having been hydrophobic-treated with dimethylsilicone oil, having a BET value of 140 $m^2/g$, and the silica particles B were changed for silica particles having been hydrophobic-treated with dimethylsilicone oil, having a BET value of 55 $m^2/g$. Using the toner obtained, evaluation was made in the same way as in Example 1. The results of evaluation are shown in Table 2.

Example 9

A toner No. 9 was obtained in the same way as in Example 1 except that the silica particles B were not used. Using the toner obtained, evaluation was made in the same way as in Example 1. The results of evaluation are shown in Table 2.

Example 10

A toner No. 10 was obtained in the same way as in Example 1 except that the silica titania composite particles No. 1 were changed for the silica titania composite particles No. 4 and that the silica particles B were not used. Using the toner obtained, evaluation was made in the same way as in Example 1. The results of evaluation are shown in Table 2.

Example 11

A toner No. 11 was obtained in the same way as in Example 1 except that the silica titania composite particles No. 1 were changed for the silica titania composite particles No. 5 and that the silica particles B were not used. Using the toner obtained, evaluation was made in the same way as in Example 1. The results of evaluation are shown in Table 2.

Example 12

A toner No. 12 was obtained in the same way as in Example 1 except that the amount of the silica titania composite particles No. 1 was changed to 1.5 parts by mass and that the silica particles A and the silica particles B were not used. Using the toner obtained, evaluation was made in the same way as in Example 1. The results of evaluation are shown in Table 2.

Example 13

A toner No. 13 was obtained in the same way as in Example 1 except that the silica titania composite particles No. 1 were changed for the silica titania composite particles No. 6. Using the toner obtained, evaluation was made in the same way as in Example 1. The results of evaluation are shown in Table 2.

Example 14

A toner No. 14 was obtained in the same way as in Example 1 except that the silica titania composite particles No. 1 were changed for the silica titania composite particles No. 7. Using the toner obtained, evaluation was made in the same way as in Example 1. The results of evaluation are shown in Table 2.

Example 15

A toner No. 15 was obtained in the same way as in Example 1 except that the silica titania composite particles No. 1 were changed for the silica titania composite particles No. 8. Using the toner obtained, evaluation was made in the same way as in Example 1. The results of evaluation are shown in Table 2.

Example 16

A toner No. 16 was obtained in the same way as in Example 1 except that the silica titania composite particles No. 1 were changed for the silica titania composite particles No. 9 and further that the silica particles A and the silica particles B were not used. Using the toner obtained, evaluation was made in the same way as in Example 1. The results of evaluation are shown in Table 2.

Example 17

A toner No. 17 was obtained in the same way as in Example 1 except that the silica titania composite particles No. 1 were changed for the silica titania composite particles No. 10 and further that the silica particles A and the silica particles B were not used. Using the toner obtained, evaluation was made in the same way as in Example 1. The results of evaluation are shown in Table 2.

Example 18

A toner No. 18 was obtained in the same way as in Example 1 except that the silica titania composite particles No. 1 were changed for the silica titania composite particles No. 11 and further that the silica particles A and the silica particles B were not used. Using the toner obtained, evaluation was made in the same way as in Example 1. The results of evaluation are shown in Table 2.

Comparative Example 1

A toner No. 19 for comparison was obtained in the same way as in Example 1 except that the silica titania composite particles No. 1 were changed for the silica titania composite particles No. 12 and further that the silica particles B were not used. Using the toner obtained, evaluation was made in the same way as in Example 1. The results of evaluation are shown in Table 2.

Comparative Example 2

A toner No. 20 for comparison was obtained in the same way as in Example 1 except that the silica titania composite particles No. 1 were changed for the silica titania composite particles No. 13 and further that the silica particles B were not used. Using the toner obtained, evaluation was made in the same way as in Example 1. The results of evaluation are shown in Table 2.

Comparative Example 3

A toner No. 21 for comparison was obtained in the same way as in Example 1 except that the polyester resin 1 was changed for the polyester resin 3 and the silica titania composite particles No. 1 for the silica titania composite particles No. 14 and further that the silica particles B were not used. Using the toner obtained, evaluation was made in the same way as in Example 1. The results of evaluation are shown in Table 2.

Comparative Example 4

A toner No. 22 for comparison was obtained in the same way as in Example 1 except that the polyester resin 1 was changed for the polyester resin 3 and the silica titania composite particles No.1 for the silica titania composite particles No. 15 and further that the silica particles B were not used. Using the toner obtained, evaluation was made in the same way as in Example 1. The results of evaluation are shown in Table 2.

Example 19

A toner No. 23 was obtained in the same way as in Example 1 except that the polyester resin 1 was changed for the polyester resin 2 and it was used in an amount of 8 parts by mass.

Using the toner obtained, evaluation was made in the same way as in Example 1. The results of evaluation are shown in Table 2.

Example 20

A toner No. 24 was obtained in the same way as in Example 1 except that the amount of the polyester resin 1 was changed to 3 parts by mass. Using the toner obtained, evaluation was made in the same way as in Example 1. The results of evaluation are shown in Table 2.

Example 21

A toner No. 25 was obtained in the same way as in Example 1 except that the polyester resin 1 was changed for the polyester resin 3. Using the toner obtained, evaluation was made in the same way as in Example 1. The results of evaluation are shown in Table 2.

Example 22

A toner No. 26 was obtained in the same way as in Example 1 except that the polyester resin 1 was changed for the polyester resin 2 and it was used in an amount of 10 parts by mass. Using the toner obtained, evaluation was made in the same way as in Example 1. The results of evaluation are shown in Table 2.

TABLE 1

| | Toner base particles | | | Silica titania composite particles | | | | | | | Hydrophobic-treated silica | |
|---|---|---|---|---|---|---|---|---|---|---|---|---|
| | | | | | | | Physical properties | | | | | |
| | Polyester resin | | Ti element | Num. av. particle | | | Before hydrophobic treatment | | After hydrophobic treatment | | | BET specific surface |
| Toner No. | No. | Amount (parts) | content (ppm) | No. | diam. (nm) | Production process | Silica content (ms. %) | Xa/Xb | Treatment | Hydrophobicity (%) | Type(s) added | area ($m^2/g$) |
| 1 | 1 | 5 | 50 | 1 | 12 | GPP | 70.0 | 87.5/12.5 | yes | 80.0 | two | 75/50 |
| 2 | 1 | 5 | 50 | 2 | 12 | GPP | 70.0 | 87.5/12.5 | yes | 62.0 | two | 75/50 |
| 3 | 1 | 3 | 35 | 2 | 12 | GPP | 70.0 | 87.5/12.5 | yes | 62.0 | two | 75/50 |
| 4 | 2 | 8 | 950 | 2 | 12 | GPP | 70.0 | 87.5/12.5 | yes | 62.0 | two | 75/50 |
| 5 | 3 | 5 | 0 | 3 | 12 | GPP | 70.0 | 87.5/12.5 | yes | 88.0 | two | 75/50 |
| 6 | 2 | 10 | 1,100 | 3 | 12 | GPP | 70.0 | 87.5/12.5 | yes | 88.0 | two | 75/50 |
| 7 | 1 | 5 | 50 | 1 | 12 | GPP | 70.0 | 87.5/12.5 | yes | 80.0 | two | 60/40 |
| 8 | 1 | 5 | 50 | 1 | 12 | GPP | 70.0 | 87.5/12.5 | yes | 80.0 | two | 140/55 |
| 9 | 1 | 5 | 50 | 1 | 12 | GPP | 70.0 | 87.5/12.5 | yes | 80.0 | one | 75 |
| 10 | 1 | 5 | 50 | 4 | 34 | GPP | 70.0 | 94.0/6.0 | yes | 80.0 | one | 75 |
| 11 | 1 | 5 | 50 | 5 | 6 | GPP | 70.0 | 77.0/23.0 | yes | 80.0 | one | 75 |
| 12 | 1 | 5 | 50 | 1 | 12 | GPP | 70.0 | 87.5/12.5 | yes | 80.0 | — | — |
| 13 | 1 | 5 | 50 | 6 | 12 | GPP | 70.0 | 87.5/12.5 | no | 0.0 | two | 75/50 |
| 14 | 1 | 5 | 50 | 7 | 12 | GPP | 70.0 | 87.5/12.5 | yes | 55.5 | two | 75/50 |
| 15 | 1 | 5 | 50 | 8 | 12 | GPP | 70.0 | 87.5/12.5 | yes | 92.0 | two | 75/50 |
| 16 | 1 | 5 | 50 | 9 | 13 | GPP | 58.0 | 87.5/12.5 | yes | 80.0 | — | — |
| 17 | 1 | 5 | 50 | 10 | 11 | GPP | 83.0 | 87.5/12.5 | yes | 80.0 | — | — |
| 18 | 1 | 5 | 50 | 11 | 15 | IW | 58.0 | 94.0/6.0 | yes | 80.0 | — | — |
| 19 | 1 | 5 | 50 | 12 | 22 | GPP | 50.0 | 82.0/18.0 | yes | 80.0 | one | 75 |
| 20 | 1 | 5 | 50 | 13 | 21 | GPP | 90.0 | 82.0/18.0 | yes | 80.0 | one | 75 |
| 21 | 3 | 5 | 0 | 14 | 38 | GPP | 70.0 | 100/0 | yes | 45.0 | one | 75 |
| 22 | 3 | 5 | 0 | 15 | 4 | GPP | 70.0 | 0/100 | yes | 45.0 | one | 75 |
| 23 | 2 | 8 | 950 | 1 | 12 | GPP | 70.0 | 87.5/12.5 | yes | 80.0 | two | 75/50 |
| 24 | 1 | 3 | 35 | 1 | 12 | GPP | 70.0 | 87.5/12.5 | yes | 80.0 | two | 75/50 |
| 25 | 3 | 5 | 0 | 1 | 12 | GPP | 70.0 | 87.5/12.5 | yes | 80.0 | two | 75/50 |
| 26 | 2 | 10 | 1,100 | 1 | 12 | GPP | 70.0 | 87.5/12.5 | yes | 80.0 | two | 75/50 |

GPP: gaseous-phase process;

IW: in-water

TABLE 2

| | | 23° C./55% Rh | | | | 30° C./80% Rh | | | | 15° C./10% Rh | | |
|---|---|---|---|---|---|---|---|---|---|---|---|---|
| | Toner No. | Dev. lines | Fog right after | Fog after 48 hrs | Transfer perf. | Dev. Lines | Fog right after | Fog after 48 hrs | Transfer perf. | Dev. lines | Fog right after | Image density stability |
| Example: | | | | | | | | | | | | |
| 1 | 1 | A | A | A | A | A | A | A | A | A | A | A |
| 2 | 2 | A | A | A | A | A | A | B | A | A | A | A |
| 3 | 3 | A | A | A | A | B | B | B | A | A | A | B |
| 4 | 4 | A | A | A | A | A | A | A | A | A | B | B |
| 5 | 5 | A | A | A | A | B | B | B | B | A | A | C |
| 6 | 6 | A | A | A | A | B | B | B | B | A | B | C |
| 7 | 7 | A | A | A | B | A | A | A | B | A | A | B |
| 8 | 8 | A | A | A | B | B | A | A | A | A | A | A |
| 9 | 9 | A | A | A | B | B | A | A | B | A | A | B |
| 10 | 10 | A | A | A | B | B | B | B | B | A | A | B |
| 11 | 11 | B | A | A | B | B | B | A | B | B | A | B |
| 12 | 12 | A | A | A | B | A | B | B | C | A | A | C |
| 13 | 13 | A | A | B | A | C | C | C | B | A | A | C |
| 14 | 14 | A | A | A | A | B | B | B | B | A | A | B |
| 15 | 15 | A | A | A | A | B | B | C | B | A | A | B |
| 16 | 16 | B | B | A | B | C | C | B | C | B | A | B |
| 17 | 17 | B | B | B | B | B | B | C | B | A | A | B |
| 18 | 18 | B | B | B | B | C | C | C | C | B | B | C |
| Comparative Example: | | | | | | | | | | | | |
| 1 | 19 | C | B | B | B | E | D | C | B | B | B | D |
| 2 | 20 | B | B | C | B | C | C | E | B | C | C | D |
| 3 | 21 | C | C | C | C | E | E | E | C | D | D | D |
| 4 | 22 | C | D | E | C | C | D | E | C | D | D | D |
| Example: | | | | | | | | | | | | |
| 19 | 23 | A | A | A | A | B | B | B | A | A | A | B |
| 20 | 24 | A | A | A | A | A | A | A | A | A | B | B |
| 21 | 25 | A | A | A | A | B | B | B | B | A | A | C |
| 22 | 2 | A | A | A | A | B | B | B | B | A | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-276355, filed Dec. 4, 2009, which is hereby incorporated by reference herein in its entirety.

What is claimed is:

1. A toner comprising toner base particles each of which contains at least a binder resin and a colorant, and silica titania composite particles, wherein;

the silica titania composite particles contain silica in an amount of from 58.0% by mass to 83.0% by mass; and in a chart obtained by the measurement by X-ray diffraction of the silica titania composite particles and where, in respect of a peak having the highest diffraction intensity and a peak having the next-highest diffraction intensity among peaks present in the range of $2\theta=24.0$ to 29.0, the value of area of the peak on a lower-angle side assigned to an anatase-type crystal of titania is represented by Xa and the value of area of the peak on a higher-angle side assigned to a rutile-type crystal of titania is represented by Xb, the ratio of Xa/Xb is from 94.0/6.0 to 77.0/23.0.

2. The toner according to claim 1, wherein the ratio of Xa/Xb is from 90/10 to 85/15.

3. The toner according to claim 1, wherein the toner base particles contain from 30 ppm to 1,000 ppm of a titanium element.

* * * * *